US009492725B2

(12) United States Patent
Jones

(10) Patent No.: US 9,492,725 B2
(45) Date of Patent: Nov. 15, 2016

(54) ROCK CLIMBING WALLS, FALL SAFETY PADS, AND ACCESSORIES

(71) Applicant: David Allan Jones, Salt Lake City, UT (US)

(72) Inventor: David Allan Jones, Salt Lake City, UT (US)

(73) Assignee: PLATYPUS IP, LLC, Salt Lake City, UT (US)

( * ) Notice: Subject to any disclaimer, the term of this patent is extended or adjusted under 35 U.S.C. 154(b) by 0 days.

(21) Appl. No.: 14/822,631

(22) Filed: Aug. 10, 2015

(65) Prior Publication Data

US 2016/0030824 A1 Feb. 4, 2016

(51) Int. Cl.
*A63B 21/00* (2006.01)
*A63B 69/00* (2006.01)
*A63B 6/02* (2006.01)

(52) U.S. Cl.
CPC ..... *A63B 69/0048* (2013.01); *A63B 6/02* (2013.01)

(58) Field of Classification Search
CPC ..... A63B 21/00
USPC ..... 482/34, 35, 36
See application file for complete search history.

(56) References Cited

U.S. PATENT DOCUMENTS 4,999,868 A 3/1991 Kraft
5,604,021 A 2/1997 Wagner
7,520,838 B1 4/2009 Sudeith et al.
7,819,778 B1 10/2010 Sudeith et al.
2013/0061393 A1 3/2013 Silverman

FOREIGN PATENT DOCUMENTS

DE 102006010413 10/2007
DE 202010004470 7/2010

OTHER PUBLICATIONS

Cushioning—Wikipedia, the free Encyclopedia (Aug. 10, 2015).
Crash Pad Review: The Best Bouldering Pad OutdoorGearLab (Aug. 6, 2015).
Crash Pads for Climbing and Bouldering (Aug. 6, 2015).
Elasticity (physics)—Wikipedia, the free encyclopedia (Aug. 10, 2015).
How to Choose the Best Bouldering Crash Pad—OutdoorGearLab (Aug. 6, 2015).
Scott Hildreth—Physics 4A—FreeFall Lab—Chabot College (Aug. 6, 2015).

*Primary Examiner* — Jerome W Donnelly

(57) ABSTRACT

The inventions disclosed herein relate to designs of climbing surfaces, fall safety pads and/or accessories related thereto. According to some embodiments, different impact zones of a fall safety pad can have different cushioning attributes. The different cushioning attributes of the different impact zones of the safety pad can be based on a vertical distance to a directly overlying portion of the climbing surface. The different cushioning attributes of the different impact zones of the safety pad can also consider a predicted or measured frequency of falling from a portion of the climbing surface directly overlying each impact zone of the safety pad. Other intended climber attributes, enjoyment, and safety concerns can be considered in the design of the climbing surface(s), safety pad(s), and accessories disclosed. Further, wear, replicability, customizations of enjoyment, and updates to safety concerns in the climbing sport are further understood in view of this disclosure.

20 Claims, 6 Drawing Sheets

300
320A
320B
320C
320D
340A
340B
340C
340D
310
x
y
z 400
420A
420B
420C
420D
420E
420F
420G
420H
420I
420J
420K
420L
420M
440A
440B
440C
440D
440E
410
x
y
z

ROCK CLIMBING WALLS, FALL SAFETY PADS, AND ACCESSORIES

BACKGROUND

Rock climbing first emerged as a sport in the mid-1800s. Early records describe climbers engaging in what is now referred to as bouldering, not as a separate discipline, but as a form of training for larger ascents. In the early 20th century, the Fontainebleau area of France established itself as a prominent climbing area, where some of the first dedicated bleausards (or "boulderers") emerged. The specialized rock climbing shoe was invented by one such athlete, Pierre Allain.

In the 1960s, the sport was pushed forward by American mathematician John Gill, who contributed several important innovations. Gill's previous athletic pursuit was gymnastics, a sport which had an established scale of difficulty for particular movements and body positions. He applied this idea to bouldering, which shifted the focus from reaching a summit to navigating a specific sequence of holds. Gill developed a closed-ended rating system: B1 problems were as difficult as the most challenging roped routes of the time, B2 problems were more difficult, and B3 problems were those that had only been completed once.

Two important training tools emerged in the 1980s: Bouldering mats and artificial climbing walls. The former, also referred to as "crash pads," prevented injuries from falling, and enabled boulderers to climb in areas that would have been too dangerous to attempt otherwise. Indoor climbing walls helped spread the sport to areas without outdoor climbing, and allowed serious climbers to train year-round regardless of weather conditions.

As the sport grew in popularity, new bouldering areas were developed throughout Europe and the United States, and more athletes began participating in bouldering competitions. The visibility of the sport greatly increased in the early 2000s, as YouTube videos and climbing blogs helped boulderers around the world to quickly learn techniques, find hard problems, and announce newly completed projects.

In early 2010, two American climbers claimed first ascents on boulder problems that have come to be regarded as the most difficult in the world: The Game near Boulder, Colo., established by Daniel Woods; and Lucid Dreaming near Bishop, Calif., established by Paul Robinson. The following year, fellow American Carlo Traversi claimed the second ascent of. The Game and in January 2014, American Daniel Woods completed the second ascent of "Lucid Dreaming." In 2011, Czech climber Adam Ondra claimed the second ascent of Gioia, originally established three years earlier by Italian boulderer Christian Core, and suggested that it was among the world's most challenging boulder problems.

Unlike other climbing sports, bouldering can be performed safely and effectively with very little equipment, an aspect which makes the discipline highly appealing to many climbers.

Bouldering is a form of rock climbing which takes place on boulders and other small rock formations, usually measuring less than 20 feet (6.1 m) from ground to top, but in some cases can measure up to 30+ ft. Unlike top rope climbing and lead climbing, no ropes are used to protect or aid the climber. Bouldering routes or "problems" require the climber to reach the top of a boulder, usually from a specified start position. Some boulder problems, known as "traverses," require the climber to climb horizontally from one position to another.

Bouldering movements are described as either "static" or "dynamic" which can add to the level of skill required, and/or likelihood of falling, using such bouldering movements. Static movements are those that are performed slowly, with the climber's position controlled by maintaining contact on the boulder with the other three limbs. Dynamic movements use the climber's momentum to reach holds that would be difficult or impossible to secure statically, with an increased risk of falling if the movement is not performed accurately. And, in the case of a bouldering race, dynamic movements may be accentuated over static movements with a corresponding increase of required skill and/or likelihood/frequency of falling as speed, dynamic movement, and/or difficulty of climbing route and holds are increased.

Again, boulder problems are generally (but not always) shorter than 20 feet (6.1 m) from ground to top. And, in a commercial indoor rock climbing wall environment, may be less. This may be so, in particular, with lower-skill, introductory, or younger climbers. The vertically shorter climbing wall (and fall therefrom) makes the sport significantly safer than free solo climbing, which is also performed without ropes, but with no upper limit on the height of the climb. However, minor injuries are common in bouldering, particularly sprained ankles and wrists. Two factors contribute to the frequency of injuries in bouldering: first, boulder problems typically feature more difficult moves than other climbing disciplines, making falls more common. Second, without ropes to arrest the climber's descent, every fall will cause the climber to hit the ground. And, considering a possible miss-hap with traditional top-roped indoor climbing, free solo climbing, and even bouldering—fall impact can vary greatly due to the height at which the un-obstructed fall began.

To prevent injuries, boulderers position crash pads near the base of the boulder to provide a softer landing, as well as one or more spotters to help redirect the climber towards the pads. Upon landing, boulderers employ falling techniques similar to those used in gymnastics: spreading the impact across the entire body to avoid bone fractures, and positioning limbs to allow joints to move freely throughout the impact.

Artificial (i.e. human made, designed, or manufactured) climbing walls are often used to simulate boulder problems in an indoor environment, usually at climbing gyms. These walls are generally constructed with wooden panels, polymer cement panels, concrete shells, or precast molds of actual rock walls. Holds, usually made of plastic, are then bolted onto the wall to create problems. The walls often feature steep overhanging surfaces, forcing the climber to employ highly technical movements while supporting much of their weight with their upper body strength. And, the wall surface can be further complicated by attaching various "volumes" to the wall to which holds are then subsequently attached.

Climbing gyms often feature multiple problems within the same section (or route) of wall. In the US the most common method Routesetters use to designate the intended route for a particular problem is by placing colored tape next to each hold—for example, holds with red tape would indicate one bouldering problem, while green tape would be used to set off a different problem in the same area.

Across much of the rest of the world problems and grades are usually designated by using a set color of plastic hold to indicate a particular problem. For example, green may be v0-v1, blue may be v2-v3 and so on. Setting via color has certain advantages, the most notable of which are that it makes it more obvious where the holds for a problem are, and that there is no chance of tape being accidentally kicked off of footholds. Smaller, resource-poor climbing gyms may prefer taped problems because large, expensive holds can be used in multiple routes simply by marking them with more than one color of tape.

Bouldering competitions occur in both indoor and outdoor settings. There are several other formats used for bouldering competitions. Some competitions give climbers a fixed number of attempts at each problem with a timed rest period in between each attempt, unlike the International Federation of Sport Climbing (IFSC) format, in which competitors can use their allotted time however they choose. In an open-format competition, all climbers compete simultaneously, and are given a fixed amount of time to complete as many problems as possible. More points are awarded for more difficult problems, while points are deducted for multiple attempts on the same problem.

In 2012, the IFSC submitted a proposal to the International Olympic Committee (IOC) to include lead climbing in the 2020 Summer Olympics. The proposal was later revised to an "overall" competition, which would feature bouldering, lead climbing, and speed climbing. In May 2013, the IOC announced that climbing would not be added to the 2020 Olympic program.

Thus, to-date, a rock climbing, or bouldering, pad has had a simple consistent design with common properties across a length and width. Further, climbing walls did not anticipate a varied, and updatable, design of a safety pad. And, variously other desired, but unrecognized problems and advantages addressed by the inventive embodiments and teachings discussed below were not previously addressed or considered.

SUMMARY

Embodiments disclosed herein relate to climbing walls, surfaces, fall safety pads and/or accessories as well as methods of design and manufacture thereof. For example, a climbing safety pad can include a first impact zone of the climbing safety pad. The first impact zone can include a first cushioning property associated with a first vertical fall distance of a climber falling from a first location of a climbing surface. The first location of the climbing surface can be located directly over the first impact zone of the climbing safety pad.

The climbing safety pad can further include a second impact zone of the climbing safety pad. The second impact zone can include a second cushioning property associated with a second vertical fall distance of the climber falling from a second location of the climbing surface. The second location of the climbing surface can be located directly over the second impact zone of the climbing safety pad.

The first cushioning property of the first impact zone of the climbing safety pad can be different than the second cushioning property of the second impact zone of the climbing safety pad.

The difference between the first cushioning property of the first impact zone and the second cushioning property of the second impact zone can be based at least in part on a difference between the first vertical fall distance and the second vertical fall distance.

Design of a safety pad, and/or climbing surface, and/or routes of a climbing surface, can further consider an associated climber skill level, an associated climber physical attribute, an associated climbing surface difficulty level, an associated climber experience level, and/or an associated fall frequency rate.

Design of a safety pad, and/or climbing surface, and/or routes of a climbing surface, can further consider vertical climber fall distances to the impact zones, impact frequency between the impact zones, climbing surface complexity directly above the impact zones, intended climber skill level regarding portions of the climbing surface directly above the impact zones, intended climber physical attributes regarding portions of the climbing surface directly above the impact zones, particular climbing problems placed on the climbing surface directly above the impact zones, a particular range of vertical distances between the climbing surface and the impact zones, a volume design directly above one or more of the impact zones, a particular set of holds directly above one or more of the impact zones, a climbing route above the first impact zone as opposed to the second impact zone, an age of intended climber associated with a climbing route above the first impact zone as opposed to the second impact zone, a measured impact level between the impact zones, and/or a measured impact frequency between the impact zones.

Other safety pad designs are disclosed as well as other climbing surface, climbing wall and accessories. And, further methods of design and/or manufacture of safety pads and climbing surfaces are also disclosed.

Indoor climbing arrangements are also disclosed. Some climbing arrangements include a climbing wall with a climbing surface, the climbing surface including a first climbing route and a second climbing route, the first climbing route located directly adjacent to the second climbing route, the first climbing route being different from the second climbing route in that the first climbing route is more difficult than the second climbing route, associated with a climber having different physical attributes than associated with the second climbing route, and/or associated with a climber having a higher skill level than that associated with the second climbing route.

A climbing arrangement can further include a climbing safety pad. The climbing arrangement can include a first impact zone directly underlying the first climbing route, the first impact zone including a first cushioning property. The climbing arrangement can further include a second impact zone directly underlying the second climbing route. The second impact zone including a second cushioning property.

The first cushioning property of the first impact zone of the climbing safety pad can be different than the second cushioning property of the second impact zone of the rock climbing safety pad.

The difference between the first cushioning property of the first impact zone and the second cushioning property of the second impact zone can be based at least in part on the difference between the first and second climbing routes.

Tiered climbing wall and safety pad arrangements are also disclosed as well as designs and accessories and features adding to social enjoyment thereof.

DESCRIPTION OF EXAMPLE EMBODIMENTS ILLUSTRATING THE INVENTION

Figure 1:
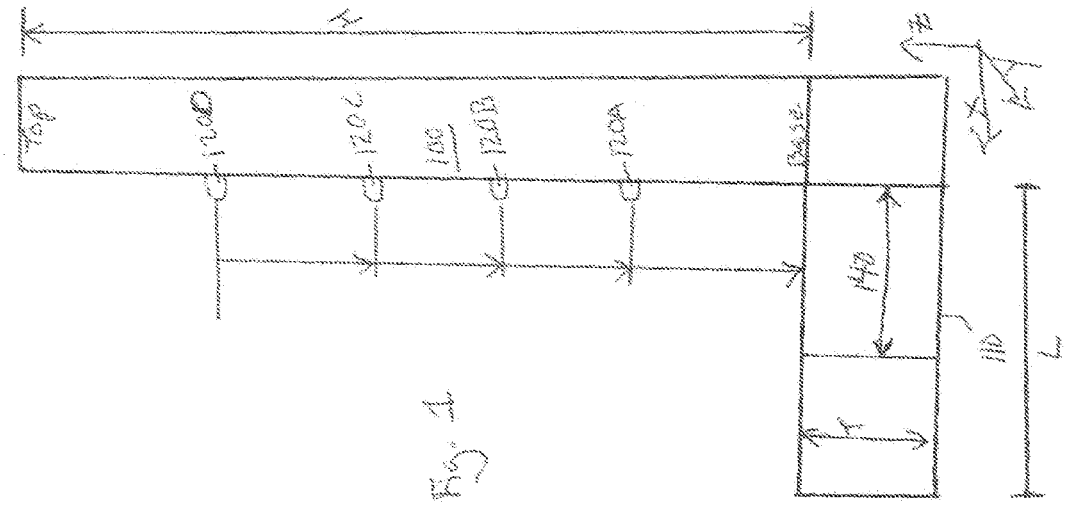
FIGS. 1-9 illustrate climbing safety pads, climbing walls, and arrangements of both pads and walls along with certain climbing accessories. Also illustrated by FIGS. 1-9 are customizations of designs and manufacturing methods illustrated therein and explained in the following detailed description.

As disclosed herein, a climbing surface can refer to a rock climbing surface, a bouldering surface, a rock climbing wall and/or a bouldering wall whether indoor or outdoor. Several of the following embodiments of the invention relate to the variable design of a safety pad dependent on the attributes of a climbing surface. In some embodiments, the design of the safety pad can vary across a length, width, and/or thickness depending on an anticipated height from which a climber is likely to fall to a particular fall location of the safety pad from the climbing surface. Moreover, the safety pad can further vary with construction, deformable property, and/or material composition across a length, width, and/or thickness of the safety pad depending on the height from which a climber is likely to fall from a climbing surface. Other climber attributes, falling attribute, climbing wall attribute, and/or safety pad properties and attributes can also be considered in the design of a safety pad and/or climbing wall as discussed hereinafter.

Thus, the design of the safety pad can be dictated by the design of the climbing wall, or vice versa. And, the design of a particular location of a climbing wall can be associated with a particular fall location (or "fall zone") of a safety pad being directly thereunder. Similarly, where the climbing wall is a naturally occurring climbing surface, the safety pad can be defined by the positions from which a climber will fall from the naturally occurring climbing surface.

Several of the following described embodiments of the invention relate to a safety pad for use with rock climbing, bouldering, or falling where a fall characteristic can be anticipated and the pad is designed based on such fall characteristic. For example: more currently, rock climbing and bouldering walls are made as opposed to being naturally occurring. In such instances, manufactured rock climbing and bouldering walls are specifically designed with predetermined routes for climbers of an intended skill level. And, often, climbing such walls can result in a climber falling from such walls at various locations of the climbing walls.

Often, the designed and made walls include specifically chosen geometries, holds, volumes, and (linear and non-linear) angles of inclination resulting in multiple routes of relative difficulty. This design of chosen geometries, holds, volumes, inclines and difficulty of routes effect (often intentionally) the difficulty of the climb, and thereby, the likelihood of a fall at particular locations of the climbing wall.

One recognition of several embodiments disclosed herein is that a climber tends to fall vertically from a wall. Thus, according to the teachings herein, a location of a fall can be anticipated. And, a fall characteristic of a fall at that location can likewise be understood and a safety pad can be designed according to this prediction. Moreover, in addition to a predetermined prediction, a fall characteristic can also be actively monitored (e.g. by impact, force, and strain sensors), analyzed, and the safety pad can be continuously modified, updated, optimized, or actively replaced. Thus, the safety pad can have embedded or overlaid, or overlaying sensors at predetermined positions across the length and width of the safety pad. Such sensor locations can be defined by a center point (or other determined location) of an impact zone of the safety pad and the location can be an equidistant grid of sensor pad locations across a length and width of the safety pad. Thus, the matrix of impact sensors can be disposed in a matrix over, under, or within the zones of the impact of the safety pad with interconnected electronic connections there between. The sensors of each individual impact zone may also be individually addressed and individually access according to an active grid, such as that used to access an individual pixels of an image display, but on a much larger scale appropriate for the size of the safety pad. Thus, a two dimensional grid of sensors spanning the length and width of the impact zones is used according to some embodiments. Moreover, as such, a pad characteristic (such as wear, anticipated or changed use, change in resiliency, or other pad characteristic) that changes over-time can likewise be monitored for compliance with a safety design, calibration, or wear, application, or use requirement.

Thus, according to several embodiments disclosed herein, a safety pad to which a climber falls can be designed based on a particular location from which the climber falls. The particular location may be defined by a climbing wall location above which a fall zone of the safety pad exists. As such, portions of the safety pad at different fall zone(s) (or location(s)) to which the climber falls) can be selected based on the design of the climbing wall. Moreover, fall characteristics at each two dimensional fall zone of a safety pad can be sensed and monitored to optimize the safety of a falling climber over-time or post-manufacture or post-installation of the safety pad. And, as a climbing wall is modified, the corresponding fall zones of a safety pad can likewise be updated to correspond to the design change of a corresponding climbing wall.

Moreover, a safety pad characteristic can be dependent on a climber attribute to which a fall zone of the safety pad is designed. For example, a weight (e.g. lbs.) height (how tall), or skill (e.g. experience related to climbing and/or falling) can be considered for a corresponding intended fall zone(s).

To illustrate, referring to FIG. 1 a climbing wall 100 is shown. The climbing wall 100 is entirely vertical and parallel to a vertical Z-direction. This vertical Z-direction also defines a thickness T of a safety pad 110. The Z-direction is parallel to the force of gravity (g) of the Earth (i.e. straight down). The safety pad 110 extends a length L in the X-direction which also extends a width W (not shown) in the Y-direction. The X-, Y-, and Z-directions are all three perpendicular to one another. And, it follows that, the length L in the X-direction and the width W in the Y-direction are perpendicular to the vertical Z-direction parallel along which climbers fall.

The height of the climbing wall 100 is defined as the distance between a ground level 130 of the climbing wall that meets the safety pad. This ground level is a position from which a climber begins climbing the climbing wall 100. The ground level 130 of the climbing wall can also be referred to as the "base" of the climbing wall 100 where the climbing wall 100 meets the safety pad 120. And, while not shown, this first example assumes a constant cross-sectional profile in the width W of the rock climbing wall 100 and the width W of the safety pad 110 in the Y-axis direction (into the illustration of FIG. 1). A1 though not shown in FIG. 1, however, the length and width of the safety pad need not always be perpendicular to the force of gravity in the Z-direction. Rather, the safety pad (or portions thereof) may be at an angle to the Z-direction to thereby further reduce the distance from which a climber falls off the climbing wall 100 to the safety pad 110.

The climbing wall 100 has a plurality of holds 120A-D. The holds are of any form and include a protrusion and/or indentation. As illustrated in FIG. 1, the holds 120A-D are disposed directly above one another and along the height H of the entirely vertical climbing wall 100. Thus, a climber's fall from any of the holds 120A-D of the entirely vertical climbing wall 100 will impact the safety pad 110 at substantially the same fall zone 140. This location of impact 140 of a safety pad 100 is referred to herein as an impact zone 140 or fall location 140. However, an impact characteristic of a fall from the holds 120A-D will be different based on a height H from which the fall began. In addition, an impact characteristic (e.g. magnitude of force) from the holds 120A-D varies due to a weight characteristic of a climber falling from each hold 120A-D. And, the safety pad's 110 characteristic in the impact zone 140 can vary due to both the weight of the climber and height H from which the climber fell.

Regarding the physics related to a climber's fall:

In 1687, English mathematician Sir Isaac Newton published Principia, which hypothesizes the inverse-square law of universal gravitation. In his own words, "I deduced that the forces which keep the planets in their orbs must [be] reciprocally as the squares of their distances from the centers about which they revolve: and thereby compared the force requisite to keep the Moon in her Orb with the force of gravity at the surface of the Earth; and found them answer pretty nearly."

This observation means that the force of gravity on an object at the Earth's surface is directly proportional to the object's mass. Thus an object that has a mass of m will experience a force:

$$\vec{F}=m\vec{g}$$

Where F is the force, m is the mass and g is the gravitational constant. In free-fall, this force is unopposed and therefore the net force on the object is its weight. For objects not in free-fall, the force of gravity is opposed by the reactions of their supports. For example, a person standing on the ground experiences zero net force, since his weight is balanced by a normal force exerted by the ground. The strength of the gravitational field is numerically equal to the acceleration of objects under its influence. The rate of acceleration of falling objects near the Earth's surface varies very slightly depending on elevation, latitude, and other factors (such as the friction of air, which is negligible in regard to this invention). Other analysis can be conducted regarding potential and kinetic energy which are well known.

For purposes of weights and measures, a standard gravity value is:

$$g=9.80665\ \text{m/s2}(32.1740\ \text{ft/s2}).$$

Assuming the standardized value for g and ignoring air resistance, this means that climber falling freely near the Earth's surface (e.g. from 10-40 feet) increases its velocity by 9.80665 m/s (32.1740 ft/s or 22 mph) for each second of its descent. Thus, a falling climber starting from rest (also assuming that the climber does not "push-off" of the climbing wall) will attain a velocity of 9.80665 m/s (32.1740 ft/s) after one second, approximately 19.62 m/s (64.4 ft/s) after two seconds, and so on, adding 9.80665 m/s (32.1740 ft/s) to each resulting velocity. This falling velocity can also be easily calculated from a given vertical distance. And, again ignoring air resistance, any and all falling climbers, when falling from the same height, will hit the safety pad at the same time. However, the force of impact (deceleration of the falling body form the falling velocity to rest) will also concern the falling climber's weight.

A modern statement of Newton's Second Law is a vector equation:

$$\vec{F}=\frac{d\vec{p}}{dt},$$

where p is the momentum of the system, and F is the net (vector sum) force. In equilibrium, there is zero net force by definition, but (balanced) forces may be present nevertheless. In contrast, the second law states an unbalanced force acting on an object will result in the object's momentum changing over time.

By the definition of momentum, $$\vec{F}=\frac{d\vec{p}}{dt}=\frac{d(m\vec{v})}{dt},$$

where m is the mass and v is the velocity.

Newton's second law applies only to a system of constant mass, and hence m may be moved outside the derivative operator. The equation then becomes $$\vec{F}=m\frac{d\vec{v}}{dt}.$$

By substituting the definition of acceleration, the algebraic version of Newton's Second Law is derived:

$$\vec{F}=m\vec{a}.$$

Newton never explicitly stated the formula in the reduced form above.

However, it is important to note that the impact of a falling climber with a safety pad is not a static analysis, but rather, a dynamic deceleration of the moving climber in an impact with the safety pad. In mechanics, an impact is a high force or shock applied over a short time period when two or more bodies collide. Such a force or acceleration usually has a greater effect than a lower force applied over a proportionally longer period. The effect depends critically on the relative velocity of the bodies to one another. In this instance, the ground is stationary and the falling climber has a velocity at impact.

At normal speeds, during a perfectly inelastic collision, an object struck by a projectile will deform, and this deformation will absorb most or all of the force of the collision. Viewed from a conservation of energy perspective, the kinetic energy of the projectile is changed into heat and sound energy, as a result of the deformations and vibrations induced in the struck object. However, these deformations and vibrations cannot occur instantaneously. A high-velocity collision (an impact) does not provide sufficient time for these deformations and vibrations to occur. Thus, the struck material behaves as if it were more brittle than it would otherwise be, and the majority of the applied force goes into fracturing the material. Or, another way to look at it is that materials actually are more brittle on short time scales than on long time scales: this is related to time-temperature superposition. Impact resistance decreases with an increase in the modulus of elasticity, which means that stiffer materials will have less impact resistance. Resilient materials will have better impact resistance.

In further addition to the immediate discussion related to force, acceleration, velocity, and impact: a frequency of fall and wear characteristic can further depend on a level of difficulty determined by the wall design, hold or route location characteristic, and skill of the climber in addition to the magnitude of fall impact at the impact zone of the safety pad based on a height of the fall and weight of the climber. Thus, the safety pad design and attributes of the climbing wall can together, or individually in-view of the other, be designed to optimize the safety and wear of the safety pad, as well as the enjoyment, excitement and continued safety of the intended climber(s). Moreover, discrete safety pad locations can be selectively replaced or added-to to optimize the safety and/or wear characteristics of the safety pad at one or more impact location zones of the safety pad.

Figure 2:
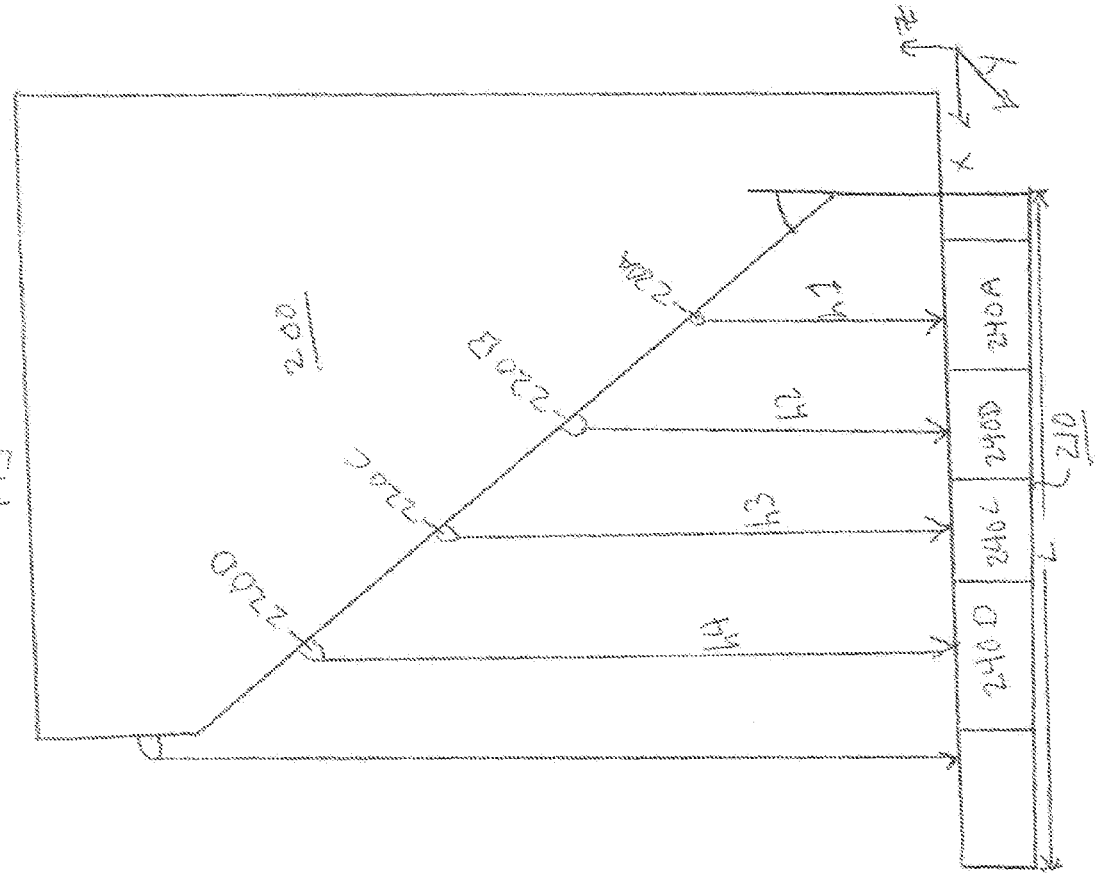

To further illustrate, FIG. 2 shows a climbing wall 200 with a plurality of holds 220A-D disposed at an angle to a safety pad 210. In this embodiment, the climbing wall 200 is not perpendicular to the safety pad 210. The climbing wall 200 is also not parallel with the Z-direction, rather is at an angle to both the Z-direction and the X-direction. Similar to FIG. 1, the holds 220A-D of the climbing wall 200 in FIG. 2 are disposed above the safety pad 210 at different heights h1-4 above the safety pad 210. However, due to the relative angle of the climbing surface 205 of the climbing wall 200 to the safety pad 210, the holds 220A-C are disposed above different fall zones 240 A-D of the safety pad 210 along the length L of the safety pad 210. And, as such, each fall zone 240A-D of the safety pad 210 will experience a different fall characteristic due to the corresponding height h1-4 from which a climber falls. That is, for example, a first fall zone 240A of the safety pad 210 is associated with a first hold 220A being at a first distance h1 from the first fall zone 240A. As a result, the first fall impact zone 240A of the safety pad 210 is associated with a first impact characteristic. The first impact characteristic of the first fall zone 240A is different than a second impact characteristic of a second fall zone 240B of the safety pad 210 related to a corresponding second hold 220B at a second distance h2 from the second fall zone 240B. A similar analysis is associated with the third 220C, fourth 220D, and . . . additional (not shown) holds 220 and . . . additional impact zones 240.

Moreover, as discussed above, a difficulty defined by the first hold 220A can be different than a difficulty defined by the second hold 220B. For example, first hold 220A may be associated with a static climbing move and second hold 220B may be associated with a higher-skilled dynamic climbing move. Thus, a frequency of impact at the first impact zone 240A can be different (i.e. higher, or lower,) than the second impact zone 250B, or vice versa, and so on for the third, fourth, and next hold. Thus, the frequency of impact at the first impact zone 240A and the second impact zone 250B can be proportional to a difficulty associated with hold 220A and 220B respectively. And, this impact characteristic (such as frequency of impact, magnitude of impact, or likelihood of impact) can also be attributed to the corresponding impact zone(s) 240 of the safety pad 240 associated with (directly beneath) associated holds 220 of the climbing wall 200. The width of an impact zone can be determined based a margin of prediction of the accuracy to which the climber falls to a particular location. Thus, the width of an impact zone can be a matter of inches, feet, or yards in length and width in the X- and Y-directions. And, regressions and interpolations between estimated impact locations, impact force applied to, and material properties of impact zones 240, from impact zone 240 to an adjacent impact zone 240, and within an impact zone 240, can likewise be made.

Moreover, as discussed with reference to any of the embodiments disclosed herein, the skill level of a climber associated with a hold or an impact zone of the safety pad can be considered. For example, where the hold is attributed to a high skill level, a fall characteristic of the impact zone of the safety pad can be considered. Where a high skill level climber is more likely to know how to fall according to correct technique, this high skill level can be considered when designing the safety pad at the corresponding impact location of the safety pad. As such, according to some examples, the impact zone of the safety pad associated with a high skill level climber may be less deformable and/or more wear resistant than in an impact zone associated with low level climbers. An impact zone associated with a similarly high skill level climber can also consider an impact from a higher fall height above the safety pad and, as a result, a corresponding larger impact and wear property from a higher impact characteristic associated with a higher skill level climber.

For another example, where the hold is attributed to a relatively low skill level climber, the impact zone corresponding the hold can consider a more frequent low skill level fall from a low skill level climber. And, the impact zone corresponding to the same hold can also consider an impact characteristic associated with a less experienced and less technically correct fall within the safety pad zone. So, a cushioning, deforming, and wear characteristic of the safety pad in the impact zone corresponding to a less experienced can be more "forgiving" or designed for a more frequent impact from less experienced climbers.

In addition to, or separate from, the height of a hold and skill level of a climber discussed above, the design and construction of a safety pad can consider a weight of an associated climber above a particular impact zone of the safety pad. For example, a body type of an associated climber can be considered when designing a safety pad or impact zone(s) characteristics of a safety pad. Where the climber to which the climbing wall is designed is a relatively old, young, heavy, light, tall, short, etc., and somewhere in-between, the associated safety pad (or safety pad zone(s)) can take into account this difference in body type to enhance climbing enjoyment and/or safety. For example, a safety pad, or safety pad zone(s), can be designed for a relatively short and low-weight child with low skill level of climbing ability and a low level of falling skills.

Thus, a safety pad, or one or more zone(s) of a safety pad, associated with a level 5 skill level (SL) climber having a level 5 weight (LBs), falling from a level 5 height (H), with a level 5 frequency (F), from a level 5 difficulty level (DL) hold will be designed differently than a level 1 skill level (SL) climber having a level 1 weight (LBs), falling from a level 1 height (H), with a level 1 frequency (F), from a level 1 difficulty level (DL) hold.

In addition to an even consideration of such impact attributes associated with a safety pad (or one or more safety pad zone(s)), these impact attributes can be individually weighted according to a predetermined, or optimized over time, algorithm. For example, a weighted algorithm can assign a relative weight to SL, LBs, H, F, DL, and DL in designing the safety pad, or safety pad zone(s). And, even, a desired safety level can be considered to maximize enjoyment by a relevant climber. For example, it might be more important to a child (or inexperienced climber) being introduced to rock climbing to enjoy a more pleasant (if possible) fall from a climbing wall than a more skilled adult climber.

Figure 3:
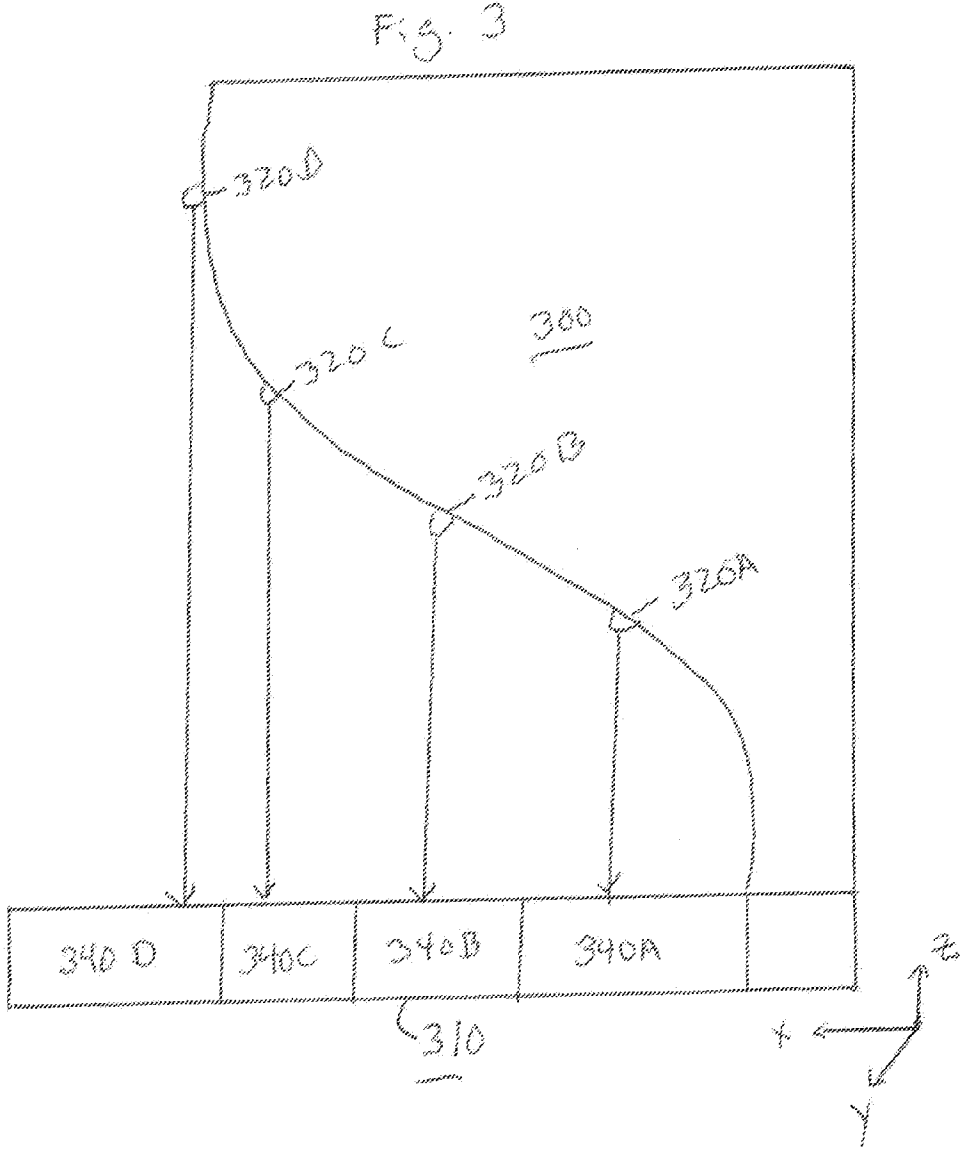
Figure 4:
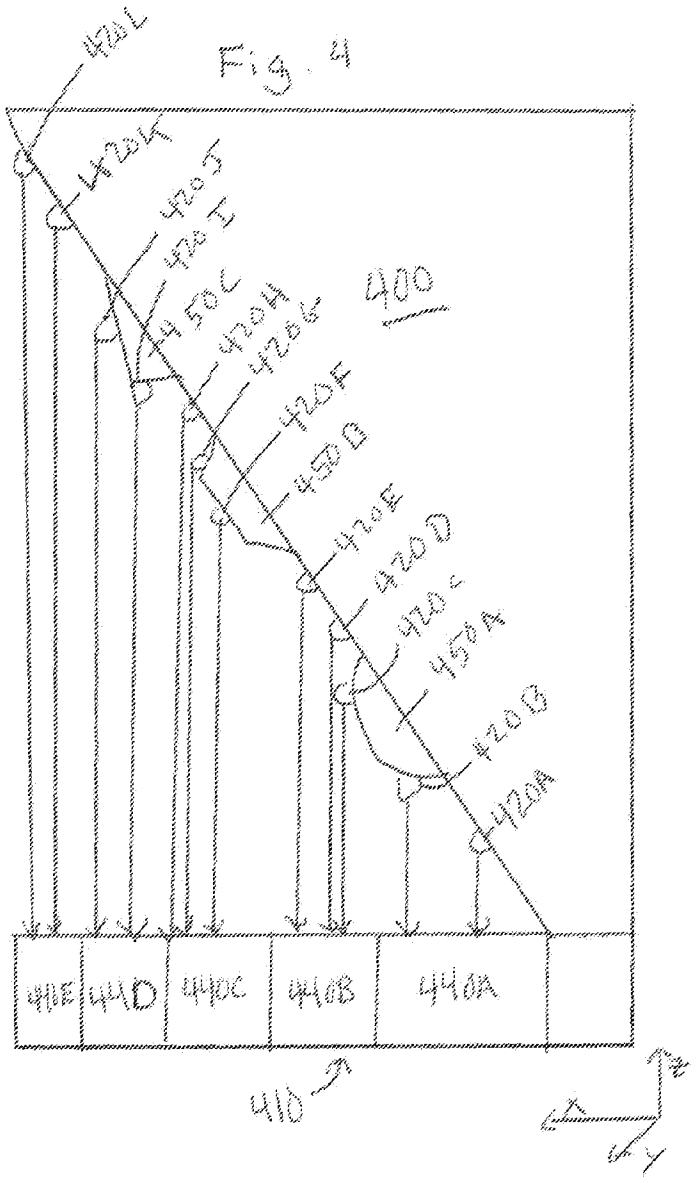

Referring now to FIGS. 3 and 4, different geometries of climbing walls 300 400 with different locations of holds 320 420 are illustrated. The climbing wall 300 can include different inclinations that may be linear or non-linear as shown in FIG. 3. The climbing wall 400 can include different volumes 450A-C attached to the climbing wall 400 further complicating the climbing wall's geometry and location of holds 420A-G thereon. The hold 320 420 in each climbing wall 300 400 design can define different impact zones 340 440 of a corresponding safety pad 310 410. And, each of the impact zones 340 440 can consider impact characteristics associated thereto by holds 320 420 and other challenged directly above.

Moreover, the geometry of a climbing wall can vary across a width W (direction Y) of the climbing wall. For example, a climbing wall may include a first cross-sectional geometry according to FIG. 1, a second cross-sectional geometry according to FIG. 2, a third cross-sectional geometry according to FIG. 3, a fourth cross-sectional geometry according to FIG. 4, and so forth. The different sections of a climbing wall can have different geometries and can be adjacent to one another with a predetermined distance there between. The transition from the geometry of one section of a climbing wall to a second section of the climbing wall can be smooth, interpolated abrupt, semi-abrupt, linear, non-linear, or a combination thereof along a width and height of the climbing wall.

And, as discussed above, the attributes of the different impact zones of the safety pad can be determined based upon the particular region (e.g. holds and location) of the climbing wall directly there above. And, the attributes of each impact zone of the safety pad can consider other attributes of the associated climber thereto as further discussed above.

Thus, as a result of that discussed above and illustrated in the figures, an attribute of the safety pad can be varied across a width, length, and/or thickness of the climbing pad. For example, the properties of the safety pad can be varied across the width, length, and/or thickness of the climbing pad due to an impact attribute (anticipated, experienced, or sensor measured impact attribute) at that location of the safety pad. For example, a deformation property of the climbing pad can be varied across a width, length, and or thickness of the climbing pad. A wear property can be varied across a width, length, and/or thickness of the climbing pad. A safety pad property at a particular impact location of the safety pad can be varied or changed by a change in design of the association location of the climbing wall. And, the portion of the safety pad at a particular impact location can be changed, replaced, or improved as an impact property of the safety pad changes, ages, or deteriorates over time.

Figure 5:
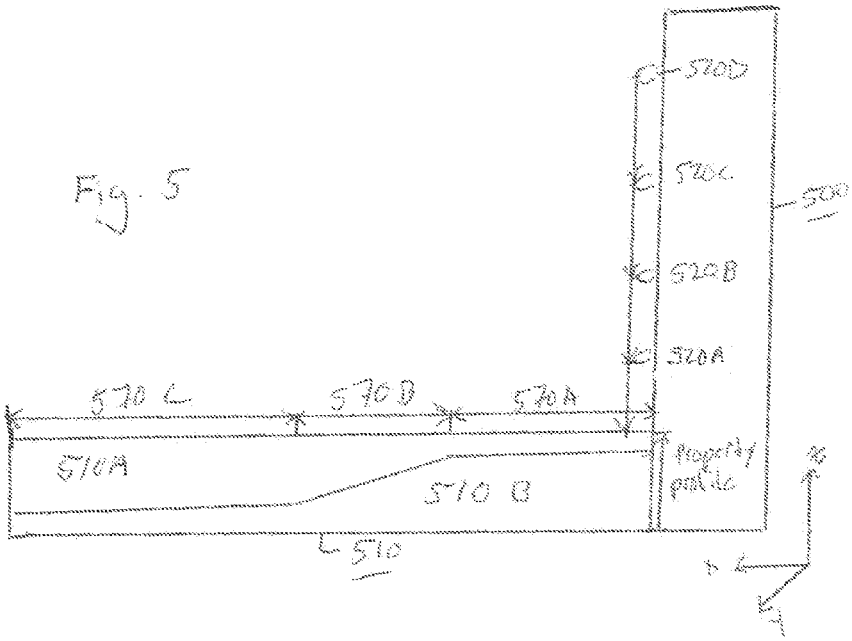
Figure 6:
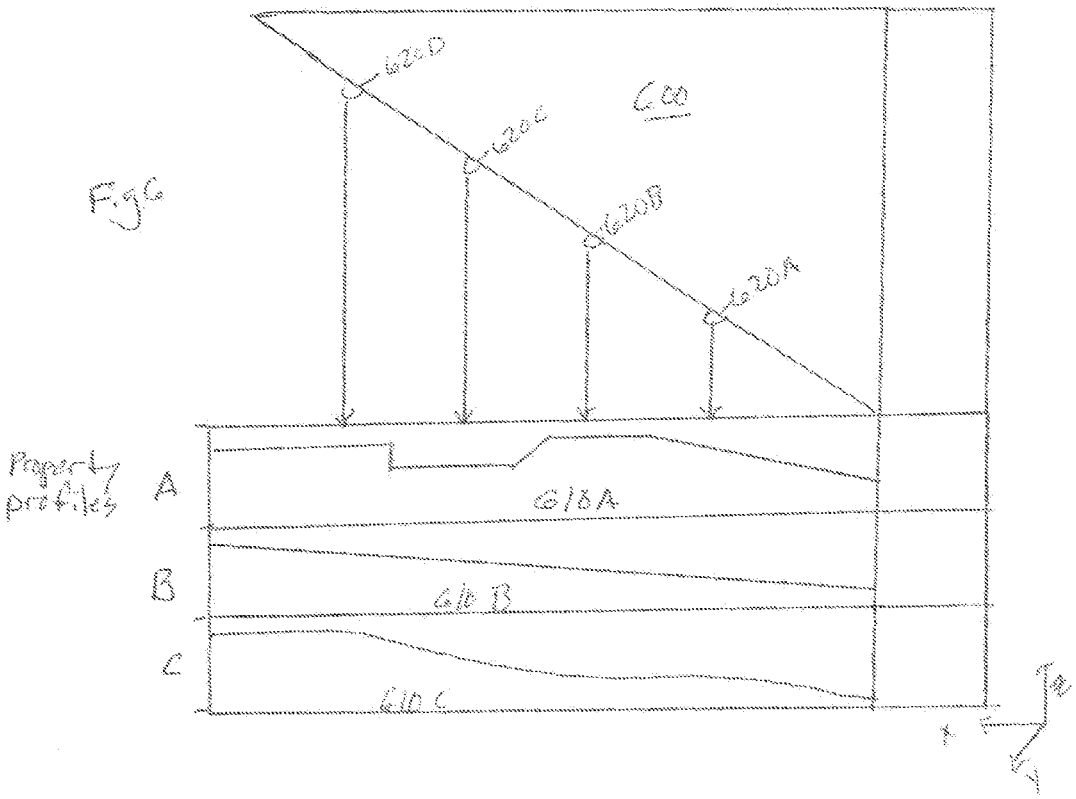
Figure 7:
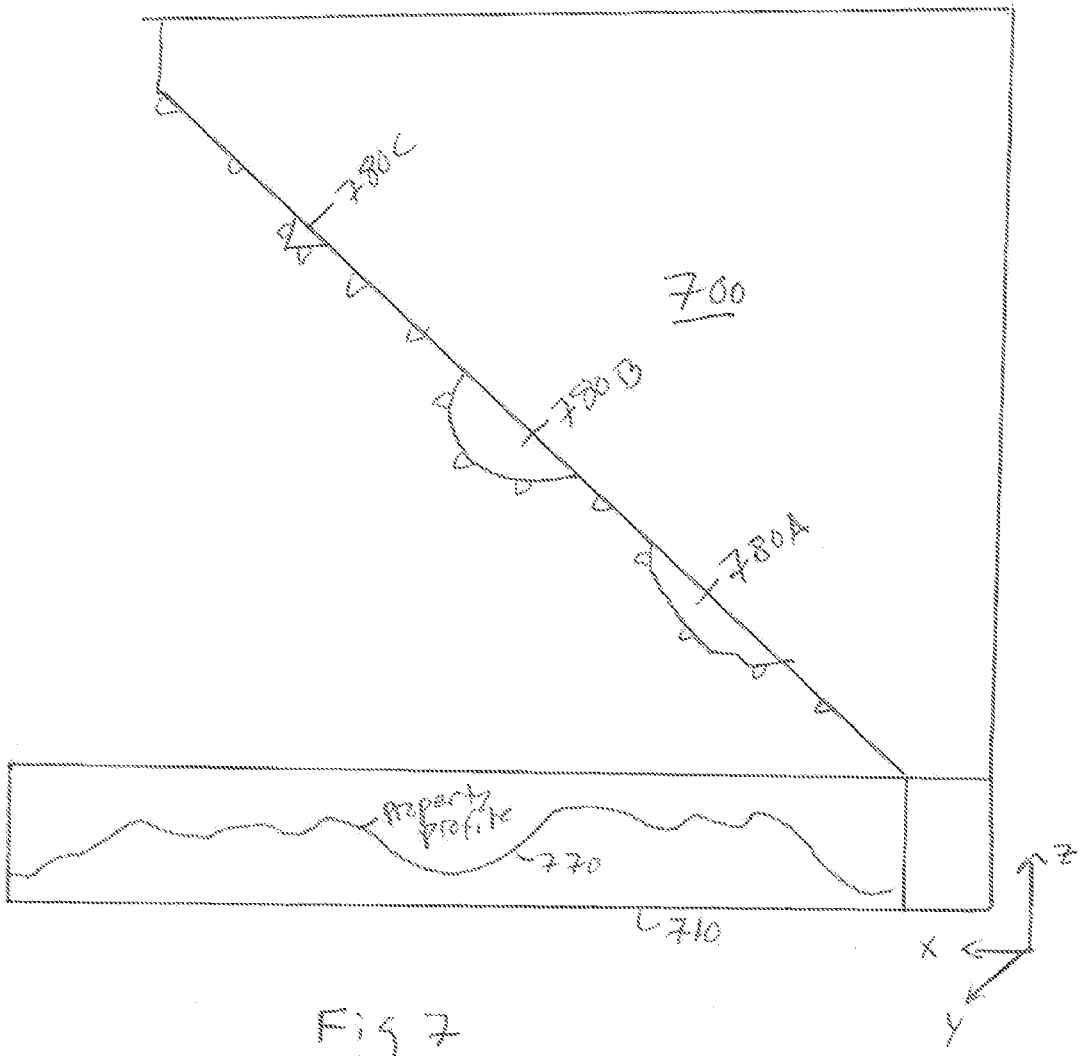

Referring to FIGS. 5-7, examples of safety pad 510 610 710 property profiles 560 660 760 are illustrated. The safety pads 510 610 710 can be designed and manufactured to include a plurality of impact zones with different impact properties as discussed above with reference to FIGS. 1-4. The impact properties can be defined by the materials used within the safety pad at various impact locations. A shown in FIG. 5, for example, the materials 510A and 510B of the safety pad 510 used can include a top layer material 510A and a bottom layer material 510B. The layers of the safety pad 510 can include the top layer with a relatively different deformability property to the bottom layer. And, any number of layers may be used as opposed to simply a top and bottom layer. The safety pad can include a casing layer to which an impact is made and the casing layer can distribute the impact to the top layer which in-turn distributes the impact to the bottom layer (or subsequent layer there between).

Thus, the top layer material 510A may be a relatively more deformable layer made of a relatively more deformable material than the bottom layer material 510B. Or, the top layer may be substantially less deformable than the bottom layer but more widely distribute an impact over a larger portion of the more deformable bottom layer, or layers there between.

The top layer may be relatively more elastic than the bottom layer, or layers there between. The top layer may be made of a "crash" material—a material that plastically deforms in the presence of a large impact. Or, the bottom layer may be a plastically deformable material in the instance that the "cushioning" of the relatively elastic top material is insufficient to absorb a large impact.

The top and/or bottom layers can further include a "fracturing" component according to a stress-strain curve. This curve can show a relationship between stress (force applied) and strain (deformation) of a safety pad material. And, the material properties of a safety pad can vary along a length, width, and/or thickness of the safety pad. The variation of material properties from an impact zone(s) to another impact zone (s) can vary. The variation in material properties can vary abruptly, linearly, and/or non-linearly from zone(s) to zone(s) and/or within a zone. And, the zone(s) may not be distinctly defined where impact zone(s) can vary in size and shape across a length width and/or thickness of a safety pad.

Regarding safety pad materials, as discussed above, the material(s) can vary themselves in mechanical properties in addition to size, location, and thickness of one or more layers.

Elastic deformation (elasticity) is reversible. Once the forces are no longer applied, the object returns to its original shape. Elastomers exhibit large elastic deformation ranges, as does rubber. However elasticity is nonlinear in these materials. Whereas plastic deformation is irreversible. However, an object in the plastic deformation range will first have undergone elastic deformation, which is reversible, so the object will return part way to its original shape. Soft thermoplastics have a rather large plastic deformation range. Hard thermosetting plastics, rubber, crystals, and ceramics have minimal plastic deformation ranges. One material with a large plastic deformation range is wet chewing gum, which can be stretched dozens of times its original length. And, rubber elasticity, a well-known example of hyperelasticity, describes the mechanical behavior of many polymers, especially those with cross-links.

The bulk properties of a polymer are the properties that dictate how the polymer actually behaves on a macroscopic scale. The tensile strength of a material quantifies how much elongating stress the material will endure before failure. This is very important in applications that rely upon a polymer's physical strength or durability (e.g. wear properties). For example, a rubber band with a higher tensile strength will hold a greater weight before snapping. In general, tensile strength increases with polymer chain length and crosslinking of polymer chains.

Young's Modulus quantifies the elasticity of the polymer. It is defined, for small strains, as the ratio of rate of change of stress to strain Like tensile strength, this is highly relevant in polymer applications involving the physical properties of polymers, such as rubber bands and damping/cushioning properties related to an impact. The modulus is strongly dependent on temperature. Viscoelasticity describes a complex time-dependent elastic response, which will exhibit hysteresis in the stress-strain curve when the load is removed. Dynamic mechanical analysis or DMA measures this complex modulus by oscillating the load and measuring the resulting strain as a function of time.

Hysteresis is the time-based dependence of a system's output on current and past inputs (e.g. wear over-time). The dependence arises because the history affects the value of an internal state. To predict its future outputs, either its internal state or its history must be known. If a given input alternately increases and decreases, a typical mark of hysteresis is that the output forms a loop as in the figure. In the elastic hysteresis of rubber, the area in the center of a hysteresis loop is the energy dissipated due to material internal friction.

A simple way to understand it is in terms of a rubber band with weights attached to it. If the top of a rubber band is hung on a hook and small weights are attached to the bottom of the band one at a time, it will get longer. As more weights are loaded onto it, the band will continue to extend because the force the weights are exerting on the band is increasing. When each weight is taken off, or unloaded, the band will get shorter as the force is reduced. As the weights are taken off, each weight that produced a specific length as it was loaded onto the band now produces a slightly longer length as it is unloaded. This is because the band does not obey Hooke's law perfectly. The hysteresis loop of an idealized rubber band is shown in the figure.

In terms of force, the rubber band was harder to stretch when it was being loaded than when it was being unloaded. This is also relevant to compression of a safety pad material. In terms of time, when the safety pad is unloaded, the cause (the force of the weight thereupon) lagged behind the effect (the thickness) because a smaller value of weight produced the same length. In terms of energy, more was required during the loading than the unloading, the excess energy being dissipated as heat.

Elastic hysteresis is more pronounced when the loading and unloading is done quickly (e.g. in an impact from falling) than when it is done slowly (e.g. due to walking on it). Materials such as rubber exhibit a high degree of elastic hysteresis.

When the intrinsic hysteresis of rubber is being measured, the material can be considered to behave like a gas. When a rubber band is stretched it heats up, and if it is suddenly released, it cools down perceptibly. These effects correspond to a large hysteresis from the thermal exchange with the environment and a smaller hysteresis due to internal friction within the rubber. This proper, intrinsic hysteresis can be measured only if the rubber band is adiabatically isolated.

For example, small vehicle suspensions using rubber (or other elastomers) can achieve the dual function of springing and damping because rubber, unlike metal springs, has pronounced hysteresis and does not return all the absorbed compression energy on the rebound. Mountain bikes have made use of elastomer suspension, as did the original Mini car.

And, rubber material cushioning materials in a safety pad are only one example of the many types of cushioning materials (or a combination thereof) used and disclosed herein for understanding of the underlying teachings related to the disclosed embodiments.

Additional cushioning materials can include:

Loose fill—Some cushion products are flowable and are packed loosely. One example of a loose fill cushion is a "bean bag chair." The safety pad, or a portion/layer thereof, can be filled and then closed to tighten the pad at a particular section or location thereof. This includes expanded polystyrene foam pieces (foam peanuts), plastic or rubber bb's, similar pieces made of starch-based foams, and common popcorn for example. The amount of loose fill material required and the transmitted shock levels vary with the specific type of material. And, the fill may also be impregnated within a setting polymer to take a desired form.

Cellulose or paper—Paper can be manually or mechanically wadded up and used as a cushioning material in a safety pad. Heavier grades of paper provide more weight-bearing ability than old newspapers. Creped cellulose wadding is also available.

Corrugated fiberboard pads—multi-layer or cut-and-folded shapes of corrugated board-type material can be used as cushion material in a safety pad. These structures are designed to crush and deform under shock stress and provide some degree of cushioning. Paperboard composite honeycomb structures are also used for cushioning in some embodiments disclosed herein.

Foam structures—several types of polymeric foams are used for cushioning in the embodiments disclosed herein. The most common are: expanded Polystyrene (also Styrofoam), polypropylene, polyethylene, and polyurethane. These can be molded engineered shapes or sheets which are cut and glued into cushion structures of safety pads. Some degradable foams are also available.

Foam-in-place is another method of using polyurethane foams. These fill the safety pad, or pad layer and can also be used to form engineered structures.

Molded pulp—pulp can be molded into shapes suitable for cushioning.

Inflated products—One example of an inflatable cushion is an automobile air-bag. Another example is an inflated balloon, inflated bounce house, or inflatable blatter to which a stunt person falls upon. Bubble wrap, for example, consists of sheets of plastic film with enclosed "bubbles" of air. These sheets can be layered as well and air communication between air-filled chambers can create a controlled distribution of air from one chamber to another in case of a large fall impact. In addition a designed pressure release valve or engineered release air exhaust opening can further be included to increase the cushioning effect. And, replacement of the "blown-open" quick-release air exhaust door can be done along with pumping air back into the inflatable chamber. A variety of engineered inflatable air cushions are also available.

Several other types of cushioning are available including suspension cushions and shock mounts underlying the safety pad or portions thereof.

Thus, any form of cushioning or a combination of cushioning materials can be used in a safety pad as disclosed herein. In fact, a safety pad may be referred to as a fall cushion. Cushioning is used to help protect fragile items, such as the human body, such as during a fall impact in the disclosed embodiments. A fall also produces potentially damaging shocks to the human body. Thus, cushioning pads help prevent, or reduce, injury due to a fall impact.

Thus, referring again to FIGS. 5-7, a variation of such properties can be designed in a safety pad. And, these material properties can be varied across the width, length, and thickness of the safety pad as well as from impact zone to impact zone (or group of impact zones to group of impact zones) or within an impact zone itself as shown by the safety pad 510 610 710 property profiles 570, 670A, 670B, 670C, and 770.

For example, referring to FIG. 5, a climbing wall 500 and safety pad 510 similar to that of FIG. 1 is shown. In this example, a property profile 570 of the safety pad 510 is illustrated across a length L in direction X of the safety pad. As shown, the material property of the safety pad 510 according to the property profile 570 is substantially consistent for a first portion 570A of the safety pad's 510 length L, then is linearly reduced along a second portion 570B to a lower level of the property of the safety pad, then is held constant at that lower level of the safety pad for a length 570C further away from the climbing wall 500. Thus, the first section 570 can be most proximate (or immediately adjacent) to the climbing wall 500, the second section 580 can be less proximate (or more remote, and further away) to the climbing wall 500 and the third section 570C can be less proximate (and more remote, and further away) to the climbing wall 500. This property profile 570 can be a modulus of elasticity and/or wear property of the safety pad as the distance from the wall is increased. And, this difference of safety pad 510 property is also different depending on impact properties, such as impact likelihood and impact magnitude association with the location of the portion 570A-C of the safety pad 510.

FIG. 6 illustrates a climbing wall 600 and safety pad 610 similar to that of FIG. 2. In this example three property profiles (profiles 610A, 610BB, and 610C) of different safety pads 610 (or different impact locations of a safety pad 610) are illustrated. As shown, the property profile 670A-C of the safety pad 610A-C can be constant, increase or decrease linearly, increase or decrease abruptly, and/or increase or decrease non-linearly across a length, width or thickness of the safety pad. The change in property profile 670A-C and be based in hold 620A-D attributes as discussed herein.

Similarly, FIG. 7 illustrates a climbing wall 700 similar to that of FIG. 4 that includes various volumes 780A-C that may be associated with various difficulties related to skill level, height, age, climber attributes, etc. As such, the material properties of the safety pad 710 can likewise vary accordingly between (and within) various impact zones (not shown) of various dimensions of the safety pad 710. And, the material property profile of the safety pad 710 can be varied according to various configurations and layers.

The construction of a complicated safety pad, such as safety pad 710 can be created using a large 3-D material disposition apparatus, such as a large 3-D printing head extruding a cushioning material upon safety pad support substrate. Distinct impact zone quadrants can be created and interlocked together by interlocking features of the underlying support substrate. Thus, a safety pad zone can be considered a square, rectangular, or triangular quadrant part of a larger safety pad that can be in individually made, interlocked together, and individually replaced as needed, desired, optimized, or in response to a rock climbing surface redesign. Similar constructions may be used to make desired climbing walls as disclosed herein as well as the climbing features such as holds and volumes. And, these holds and volumes may also be constructed so as to be interlockable and replaceable or customizable as well.

According to embodiments disclosed herein, a climbing and/or bouldering wall can include more than one portion with a fall-reset flooring disposed there between. For example, referring to FIG. 8, climbing walls 800A1, A2, B1, and B2 with multiple safety pads 810A1, A2, B1, and B2 are illustrated. This embodiment is particular desirable in a multi-teared bouldering wall environment which may be adjacent to top-roped climbing walls in a common climbing gym. In this example, a climber is allowed to climb a first climbing wall 800A1 that may be without the aid of a climbing rope—e.g. a first bouldering wall 800A1. While climbing the first climbing wall 800A1, the climber is protected by a first safety pad 810A1. And, a predetermined safe height of the first climbing wall 800A1 is retained. The first, and subsequent, safety pads 810 can have any configuration disclosed herein.

After climbing the first climbing wall 800A1, the climber climbs onto a second safety mat 810A2 using a ladder 880A, for example. The climber walks across the second safety mat 810A2 and begins climbing the second climbing wall 800A2 also limited to a safe second height above the second safety pad 810A2. The second climbing wall 800A2 can be of increased angle relative to the Z-vertical direction as opposed to the first climbing wall 800A1 such that a fall from the second climbing wall 800A2 to the second safety pad 810A1 will not result in a fall beyond the edge of the second safety pad 810A2. Additional measures, such as a net 880B, can also be included to further prevent a fall from the second safety pad 810A2 to the first safety pad 810A1. And, upon successfully climbing to the top of the second climbing wall 800A2 (or an additional subsequent climbing wall) a climber can be allowed to descend (e.g. by a repelling rope 890A) back to the base floor of the climbing gym to begin climbing again. In this way, the climber is not required to climb back down the climbing walls 800A1 and 800A2 and subsequent climbers may begin climbing without waiting for the previous climber to climb down the climbing wall(s). And, in-fact, a climber's enjoyment of climbing may be increased with a lack of the need to climb back down a bouldering climbing wall. And, an increased number of climbing routes can be vertically added without the need of laterally introducing new climbing obstacles.

Figure 8:
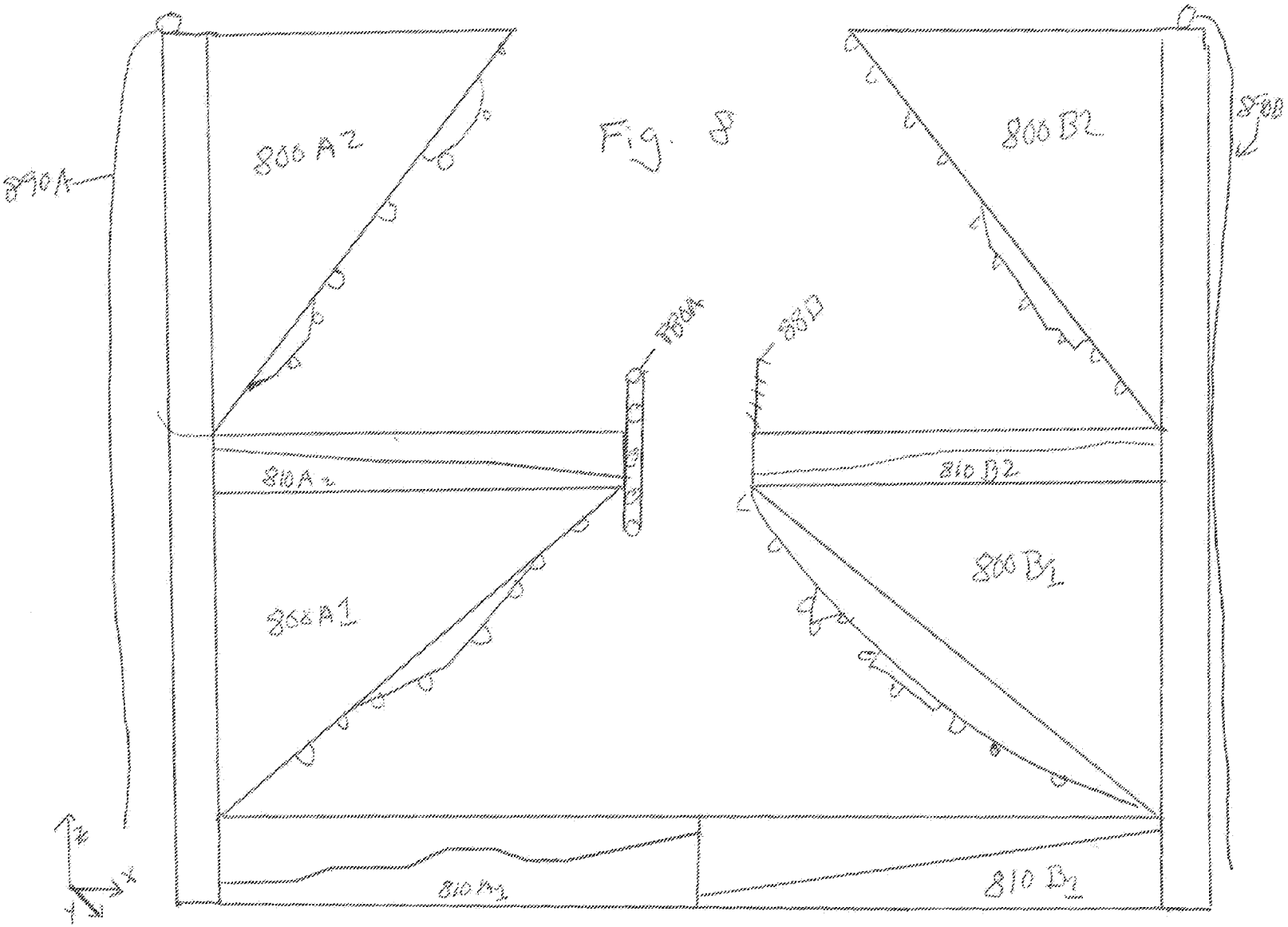

In addition, according to such embodiments, a vertical utilization of climbing gym space is used. For example, in an indoor climbing gym, a rock climbing wall used for rope-secured climbing may be 40+ feet high. However, a bouldering wall may only be 15-20 feet high, or sometimes less. Thus, with a multi-tiered bouldering wall design as illustrated in FIG. 8, this vertical-space of an indoor climbing gym can be more fully utilized by serially and vertically scalable boulder walls as shown in FIG. 8. A similarly tiered dual vertically disposed climbing walls 800B1 and 800 B2 and corresponding similarly tiered dual vertically disposed climbing walls 810B1 and 810B2 may be included where a climber may be allowed to transition from climbing wall 800A1 to climbing wall 800B2; and from climbing wall 800B1 to climbing wall 800A2, if desired to add additional variety to the experience. And, adjacent climbing routes may be disposed across a width of climbing walls 800A1, A2, B1, and B2 as previously discussed. Thus, any of the teachings herein can be variously combined as disclosed herein.

Regarding climbers who enjoy the thrill of a more "free" climbing experience, such climbers will find additional excitement and relative safety according to many of the embodiments disclosed herein. That is—free solo climbing, also known as free soloing, is a form of free climbing where the climber (the free soloist) goes alone and does not use ropes, harnesses and other protective gear while ascending, relying only on his or her climbing ability. Unlike in bouldering, climbers go beyond safe heights and a fall always means serious injury or death. Free solo climbing should not be confused with normal free climbing, in which gear is used for safety in case of a fall, but not to assist the climb. Thus, free solo climbing is generally not used in commercial indoor climbing gyms. However, one may well be able to increase the relative safety of experienced bouldering, or free soloing, to a certain extent using various teachings as disclosed herein.

Various embodiments disclosed herein can also benefit a social aspect of climbing as consideration of a climbing wall and/or a safety pad are designed. For example, a climbing experience can be enhanced where climbers of different attributes are considered with regards to enjoying the sport of climbing together. In an embodiment of such example, a first climber having first attributes may enjoy climbing adjacent to a second climber having second attributes. The first climber may be a relatively higher skill level than the second climber. The first climber may be relatively older than the second climber (e.g. the first climber may be a parent of the second climber; or, the first climber may be a relatively more experienced friend of the second climber). The first climber may be relatively heavier than the second climber. The first climber may be relatively taller than the second climber. The first climber may fall more frequently than the second climber, enjoy a more difficult climbing experience than the second climber, and/or be more skilled at falling than the second climber, and so forth.

Figure 9:
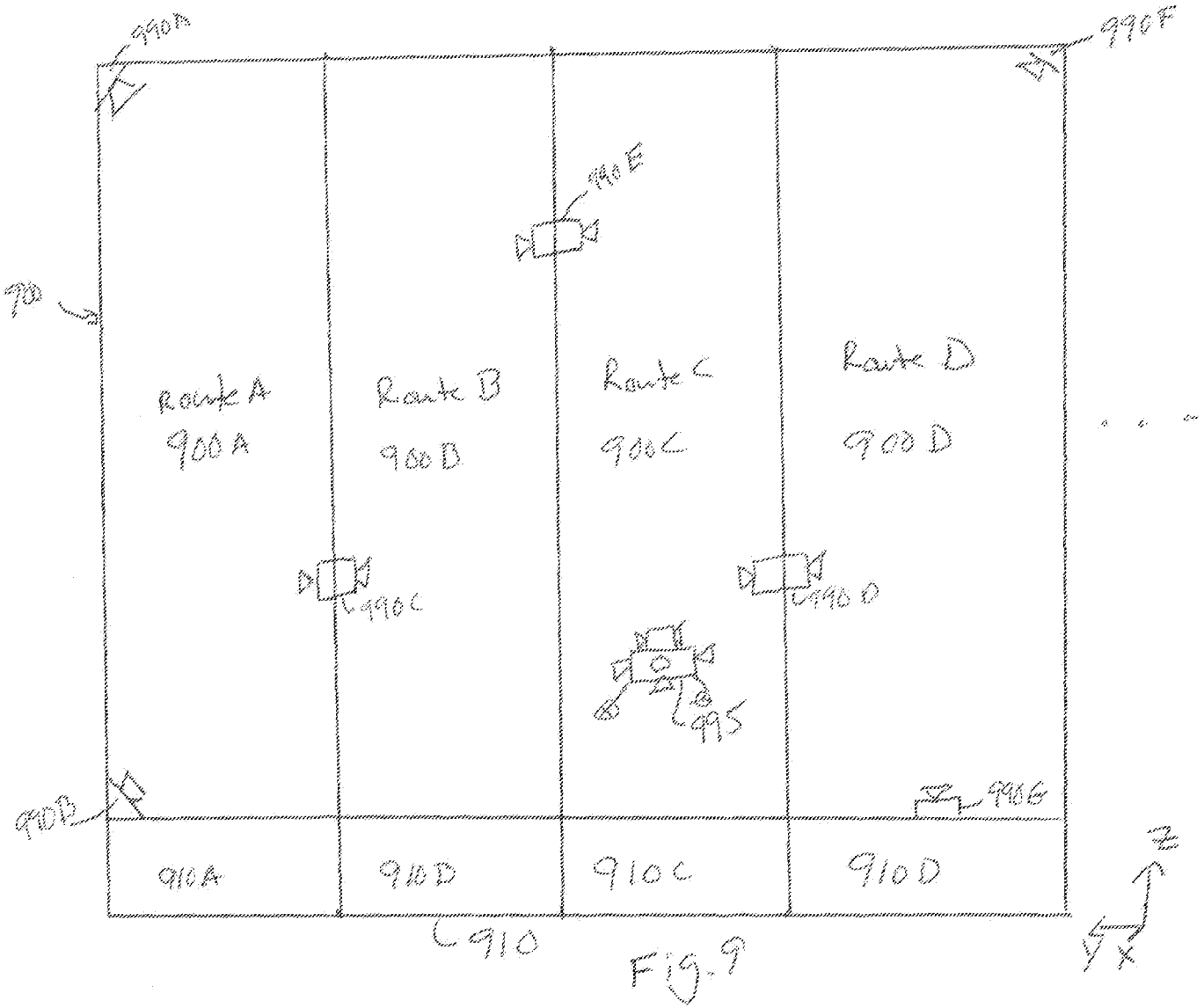

Referring to FIG. 9, according to the teachings disclosed herein, a first route A of a climbing wall 900 can include a first set of holds (not shown) designed for the first climber; and a second route B of the same climbing wall includes a second set of holds (not shown) designed for the second climber. However, the first and second routes A and B can be intentionally located adjacent to one another (as opposed to separate areas of a climbing gym) as shown such that the first and second climbers can individually enjoy their own particular climbing experience along their own climbing route while also enjoying this experience in a relatively close climbing vicinity. The climbing route A and holds (not shown) associated with the first climber can be color identifiable from the route B and holds (not shown) associated with the second climber. And, as discussed above, the impact zone(s) 901A-D of the safety pad 910 associated with the first and second climbers can be designed according to attributes of the particular climber (e.g. considering corresponding impact attributes). And, as such, increased enjoyment of climbing vicinity between two or more climbers of different climbing abilities are enabled, and safety enjoyed, with increased social value.

Due to this increased social value, social recordings can similarly be made by simultaneous image and/or audio capture of both climbers along the climbing experience. For example, one or more video and/or audio recording devices 990A-G can be disposed along, and adjacent to routes A-D so as to simultaneously capture and record the climbing experience of any climbers scaling routes A-D. The capture devices 990 can be located so as to capture a perspective view of the climbers and the capture devices 990 can be disposed at predetermined locations based on perspective or identified challenges associated with the particular routes A-D. In some instances the video and/or audio capturing devices 990 can be located along the climbing routes A and B of the first and second climbers. The routes A and B of the first and second climbers can include climber proximity sensors that sense the proximity of each climber to the recording devices 990A-E. The proximity sensor, such as a camera or motion sensor, can be included in the capture devices 990. Once both climbers are within a vicinity (or field of video capture) of the recording devices 990 the video and/or audio recording of both climbers can be recorded with both climbers together within the image capture frame of the capture device 990.

In addition, the video and/or audio capture of one or more climbers can be accomplished using an aerial vehicle 995 having an audio and/or video capture device disposed thereon. The aerial vehicle 995 can be an aerial drone 995 with an audio and/or video capture device disposed upon the drone 995 with wireless proximity sensing device disposed upon the drone. Regarding the wireless proximity sending device, both the first and/or second climbers can wear a proximity transmitting device in communication with the proximity sensing device associated with the aerial recording vehicle 995.

In some embodiments, the aerial recording vehicle 995 can sense the proximity of both climbers and determine an optimized aerial recording position relative to both climbers. For example, the aerial vehicle 995 can consider a position which captures video imagery of both climbers within a certain threshold of desired margins of the recorded frame boundary. For example, the recorded capture can consider a center point between both climbers as a center point of a desired recording. The aerial vehicle can use a leveling sensor and position sensor of the aerial vehicle to optimize recording of the first and second climbers. An optimized boundary may be considered to ensure an appropriate distance between both climbers and a periphery of the capture view. And, the aerial location of the aerial vehicle 995, and/or control of the image capture device upon the aerial vehicle 995, can be determined so as to capture an optimized recording of the first and second climbers as they negotiate their particular climbing routes A and B.

In some embodiments, the aerial vehicle 995 (or multiple aerial vehicles) can include at least two coordinated audio and/or video recording devices. These recording devices can be in coordination with one another and assigned a particular one of the first or second climbers. The images recorded by each of the first and second recording devices can be rectified with respect to one another. For example, an image taken by a first recording device regarding a first climber can be rectified and coordinated with a recording of the second climber made by a second recording device. Where the recording of the first climber becomes unduly distanced from the second recording of the second climber, the recording of the first climber can be automatically isolated from the recording of the second climber and no longer rectified or coordinated together. For example, where the first climber's location differs from the second climber less than ten feet the recording of the first and second climbers can be presented together whether by a single capture of both climbers together or by a coordination of two separate recordings. Once the distance between the two climbers increases beyond a particular predetermined amount, the recording of each climber can be automatically reassigned to an independent recording thereof by individual cameras disposed on the one or more aerial vehicles. Then, when the vicinity of the climbers to one another becomes less than the predetermined distance, the separate recordings thereof can once again be coordinated or switched to a common dual climber recording device. And, rectifying transmitters or features 996, such as recognizable light transmitter (e.g. by polarization or light modulation) can be sensed and used to rectify adjacent images using sensing of the locations of the identifiable transmitters 996.

The use of the aerial vehicle 995, such as a drone, has advantages to various other static-based recording apparatus. For example, a climber-mounted recording device such as a GOPRO does not provide an exciting later review of the same perspective. Rather, the GOPRO is captures from the position upon the climber from which it is held.

Similarly, a land-mounted recording device is held to a perspective from which it is located or constraints of the mount to which it is attached. And, as an aerial vehicle is not generally held to a three dimensional location, a wide array of recording positions are thereby enabled including vertical and lateral distance locations to simultaneously the first, second, and/or both climbers. Similar advantages can also be considered with respect to athletes enjoying other sports than climbing as well.

One skilled in the art will appreciate that, for this and other processes and methods disclosed herein, the functions performed in the processes and methods may be implemented in differing order. Moreover, the structures of apparatus may be reorganized or variated used to accomplish a given feature or function. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It is understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, quadrants, thirds, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 routes refers to groups having 1, 2, or 3 routes. Similarly, a group having 1-5 impact zones refers to groups having 1, 2, 3, 4, or 5 impact zones and more or less, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. All references recited herein are incorporated herein by specific reference in their entirety.

What is claimed is:

1. A method of manufacturing a climbing safety pad, comprising:

selecting a first cushioning property of a first impact zone of the climbing safety pad, the first cushioning property associated with a first vertical fall distance of a climber falling from a first location of a particular climbing surface, the first location of the particular climbing surface being located directly over the first impact zone of the climbing safety pad;

selecting a second cushioning property of a second impact zone of the climbing safety pad, the second cushioning property associated with a second vertical fall distance of the climber falling from a second location of the particular climbing surface, the second location of the particular climbing surface being located directly over the second impact zone of the climbing safety pad, wherein:

the first cushioning property of the first impact zone of the climbing safety pad is different than the second cushioning property of the second impact zone of the climbing safety pad; and the difference between the first cushioning property of the first impact zone and the second cushioning property of the second impact zone is based at least in part on a difference between the first vertical fall distance and the second vertical fall distance from the particular climbing surface; and manufacturing the climbing safety pad having the previously selected first and second cushioning properties corresponding to the first and second fall distances of the particular climbing surface.

2. The method of manufacturing the climbing safety pad according to claim 1, wherein the climbing safety pad is designed to be used indoor.

3. The method of manufacturing the climbing safety pad according to claim 1, wherein the particular climbing surface is an indoor artificial rock climbing wall.

4. The method of manufacturing the climbing safety pad according to claim 1, wherein the particular climbing surface is bouldering wall.

5. The method of manufacturing the climbing safety pad according to claim 4, wherein the bouldering wall is less than 20 feet high.

6. The method of manufacturing the climbing safety pad according to claim 1, wherein the first location is associated with a first difficulty level and the second location is associated with a second difficulty level, wherein the second difficulty level is more difficult than the first difficulty level.

7. The method of manufacturing the climbing safety pad according to claim 1, wherein the first location is associated with a first climbing route and the second location is associated with a second climbing route.

8. The method of manufacturing the climbing safety pad according to claim 1, wherein first location is associated with a first set of climbing problems and the second location is associated with a second set of climbing problems.

9. The method of manufacturing the climbing safety pad according to claim 8, wherein the first set of climbing problems includes different holds and volumes than the second set of climbing problems.

10. The method of manufacturing the climbing safety pad according to claim 1, wherein the first impact zone includes a first impact sensor and the second impact zone includes a second impact sensor.

11. The method of manufacturing the climbing safety pad according to claim 10, wherein the climbing safety pad is manufactured to be modified based on monitored impact characteristics sensed by the first and second impact sensors.

12. The method of manufacturing the climbing safety pad according to claim 1, further comprising manufacturing a matrix of impact sensors disposed in a matrix over, under, or within the first and second impact zones.

13. The method of manufacturing the climbing safety pad according to claim 1, wherein the second cushioning property is more prone to plastic deformation than the first cushioning property.

14. The method of manufacturing the climbing safety pad according to claim 1, further comprising:

selecting a third cushioning property of a third impact zone of the climbing safety pad, the third cushioning property associated with a third vertical fall distance of the climber falling from a third location of the particular climbing surface, the third location of the particular climbing surface being located directly over the third impact zone of the climbing safety pad, wherein:

the third cushioning property of the third impact zone of the climbing safety pad is different than the first and second cushioning properties of the first and second impact zones of the climbing safety pad; and the difference between the third cushioning property of the third impact zone and the first and second cushioning properties of the first and second impact zones is based at least in part on a difference between the third vertical fall distance and the first and second vertical fall distances from the particular climbing surface; and manufacturing the climbing safety pad having the previously selected first, second, and third cushioning properties corresponding to the first, second, and third fall distances of the particular climbing surface.

15. The method of manufacturing the climbing safety pad according to claim 1, wherein the first and second impact zones are immediately adjacent to one another.

16. The method of manufacturing the climbing safety pad according to claim 1, wherein the first and second location of the particular climbing wall are immediately adjacent to one another.

17. The method of manufacturing the climbing safety pad according to claim 1, wherein the first impact zone includes a molded, formed, or expanded foam structure and the second impact zone includes a loose fill structure.

18. The method of manufacturing the climbing safety pad according to claim 1, wherein the first impact zone includes a molded, formed, or expanded foam structure and the second impact zone includes an inflated structure.

19. The method of manufacturing the climbing safety pad according to claim 1, wherein the second impact zone includes a lower wear characteristic than the first impact zone, wherein the higher wear characteristic results in a higher resistance to wear related to fall impacts thereto.

20. The method of manufacturing the claiming safety pad according to claim 1, wherein the second cushioning property of the second impact zone gradually increases in resiliency across the second impact zone.

* * * * *